US005220892A

United States Patent [19]

Boemer

[11] Patent Number: 5,220,892

[45] Date of Patent: Jun. 22, 1993

[54] LUBRICATING SYSTEM

[75] Inventor: Emil Boemer, Cologne, Fed. Rep. of Germany

[73] Assignee: Kloeckner-Humboldt-Deutz Aktiengesellschaft, Cologne, Fed. Rep. of Germany

[21] Appl. No.: 886,951

[22] Filed: May 21, 1992

[30] Foreign Application Priority Data

May 25, 1991 [DE] Fed. Rep. of Germany ..... 4117161
Jul. 17, 1991 [DE] Fed. Rep. of Germany ..... 4123642

[51] Int. Cl.[5] ..... F01M 5/00
[52] U.S. Cl. ..... 123/196 AB
[58] Field of Search ..... 123/196 AB, 41.33; 184/6.22

[56] References Cited

U.S. PATENT DOCUMENTS

| | | | |
|---|---|---|---|
| 2,133,514 | 10/1938 | Holmes | 123/41.33 |
| 2,365,166 | 12/1944 | Bay | 123/41.33 |
| 2,417,237 | 3/1947 | Chandler | 123/41.33 |
| 3,090,365 | 5/1963 | Constantino | 184/6.22 |
| 3,990,424 | 11/1976 | Miersch | 123/196 AB |
| 4,027,643 | 6/1977 | Feenau et al. | 123/196 AB |
| 4,156,407 | 5/1979 | Moll et al. | 123/196 AB |
| 4,248,293 | 2/1981 | Kamezaki et al. | 123/196 AB |
| 4,258,676 | 3/1981 | Lamm | 123/196 AB |
| 4,503,679 | 3/1985 | Saito et al. | 184/6.22 |
| 4,512,300 | 4/1985 | DeVore et al. | 123/196 AB |

FOREIGN PATENT DOCUMENTS 2629730 9/1978 Fed. Rep. of Germany .

*Primary Examiner*—Willis R. Wolfe
*Assistant Examiner*—Erick Solis
*Attorney, Agent, or Firm*—Charles L. Schwab

[57] ABSTRACT

A differential pressure valve 6 is provided in an engine lubricating system which spills lubricating oil into a bypass line 5b bypassing a lubricating oil heat exchanger 7. Connected downstream of the differential pressure valve 6, is a pressure-maintaining valve 10, which holds the oil pressure approximately constant when the internal-combustion engine is running and protects the lubricating oil pump against too high a pressure upon starting of a cold internal-combustion engine.

5 Claims, 1 Drawing Sheet

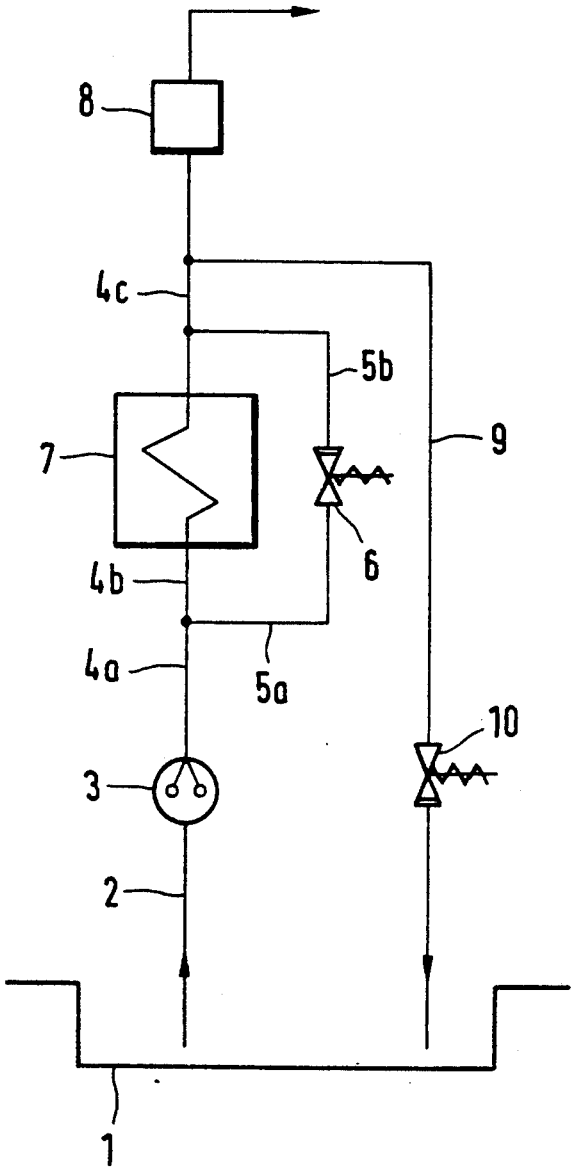
8
4c
5b
7
9
6
4b
4a
5a
10
3
2
1

LUBRICATING SYSTEM

TECHNICAL FIELD

This invention relates to an internal-combustion engine having a crankcase in which a crankshaft is rotatably supported, to which crankshaft there is attached at least one connecting rod having a piston that is movable in a cylinder, the cylinder being covered by a cylinder head and a lubricating system being present, which lubricating system exhibits at least a lubricating oil pump, a pressure control valve, an oil filter, and a bypass line to a lubricating oil heat exchanger.

PRIOR ART STATEMENT

The lubricating system shown and described in German patent document DE-OS 26 29 730 delivers lubricating oil from the oil pan of an internal-combustion engine, via a filter and a heat exchanger, to the lubrication or cooling points of the internal-combustion engine. The heat exchanger can be bypassed via a bypass line. A pressure control valve, which limits the pressure in the lubricating system immediately downstream of the oil pump to a maximum value, spills into the oil pan or into the suction line to the oil pump. By this means, a portion of the heated oil is bypassed around the heat exchanger, in particular at high rotation speed and thus usually high loading of the internal-combustion engine, so that a high oil temperature comes about in the oil pan as a whole. The oil conveyed through the heat exchanger via the filter must be cooled correspondingly strongly before it is conveyed to the lubrication and cooling points of the internal-combustion engine. As a consequence, the heat exchanger must be designed very large.

OBJECTS AND SUMMARY OF THE INVENTION

It is an object of the invention to create an internal-combustion engine having a lubricating system that avoids these disadvantages and, moreover, is compact and economical in construction.

This object is achieved by virtue of the fact that the pressure control valve, designed as a differential pressure valve, spills into the bypass line and that a pressure-maintaining valve, spilling into the oil pan, is inserted in a pressure line leading from the lubricating oil heat exchanger to the oil filter.

The differential pressure valve is adjusted such that it opens only when there is a very high resistance in the heat exchanger (this is the case, as a rule, only when the oil viscosity is low, that is, on starting and warmup of an extremely cold internal-combustion engine). The pressure-maintaining valve holds the oil pressure approximately constant when the internal-combustion engine is running. By means of these measures, the full quantity of oil can always be run through the heat exchanger when the internal-combustion engine is warm, as a consequence of which the heat exchanger can be kept very small and the oil temperature in the oil pan is lower. The oil pump is likewise protected against too high a pressure upon starting with cold oil, because the largest part of the oil is then returned to the oil pan, first via the pressure control valve and then via the pressure-maintaining valve.

In development of the invention, the pressure difference across the differential pressure valve is set to preferably 1.5 bar and the triggering pressure of the pressure-maintaining valve is set to preferably 5 bar. These values have proved desirable in the cited value ranges of 0.5 to 3.5 and 3 to 7 bar. In every case it is important that the triggering pressure of the pressure-maintaining valve be set to a higher value than that of the differential pressure valve.

BRIEF DESCRIPTION OF THE DRAWING

Further advantageous embodiments can be taken from the following description of the Drawing, in which an exemplary embodiment of the invention, illustrated in the FIGURE, is described. The FIGURE shows a lubricant circuit for an engine having an oil cooler bypass.

DETAILED DESCRIPTION OF THE DRAWINGS

An internal-combustion engine, which can be, for example, an auto-ignition internal-combustion engine, has an oil pan 1, into the bottom region of which a suction line 2 of a lubricating oil pump 3 extends. The lubricating oil pump 3 delivers the oil into a pressure line 4*a*, from which a bypass line 5*a* branches off. A differential pressure valve 6 is inserted into this bypass line 5*a*. The outlet of the differential pressure valve 6 opens into the continuation of the bypass line 5*b*.

Further, a pressure line 4*b* leads into a lubricating oil heat exchanger 7 from the branching point of the pressure line 4*a* to the bypass lien 5*a*. From the lubricating oil heat exchanger 7, the cooled lubricating oil is conveyed via the continuation of the pressure line 4*c* to an oil filter 8, and from there to the lubrication points of the internal-combustion engine. If appropriate, a further subdivision into a lubrication circuit and a cooling circuit is also conceivable. In this case, the cooling circuit can be employed for cooling of the pistons (splash oil cooling) or, however, also of the cylinders and of the cylinder head.

The bypass line 5*b* opens into the pressure line 4*c* while, downstream of the opening point, a spill line 9 branches off to a pressure-maintaining valve 10. The outlet of the pressure-maintaining valve 10 opens, in turn, into the oil pan 1.

The pressure of the pressure-maintaining valve 10 is set to a pressure of roughly 5 times atmospheric pressure, while the pressure difference of the differential pressure while valve 6 is set to roughly 1.5 times atmospheric pressure.

The embodiments of the invention in which an exclusive property or privilege is claimed are defined as follows:

1. An internal combustion engine having a crankcase in which a crankshaft is rotatably supported, to which crankshaft there is attached at least one connecting rod having a piston that is movable in a cylinder, the cylinder being covered by a cylinder head and a lubricating system being present, said lubricating system exhibits at least a lubricating oil pump, a pressure control valve, an oil filter, and a bypass line bypassing a lubricating oil heat exchanger, characterized by the fact that the pressure control valve is designed as a differential pressure valve (6), and spills oil into the bypass line (5*b*) and that a pressure-maintaining valve (10), spills oil into the oil pan (1), and is inserted in a pressure line (4*c*) leading from the lubricating oil heat exchanger (7) to the oil filter (8).

2. The internal combustion engine of claim 1 wherein the pressure difference of said differential pressure valve (6) is set at a value between 0.5 and 3.5 times atmospheric pressure.

3. The internal combustion engine of claim 2 wherein the pressure difference of said differential pressure valve is set at a value of substantially 1.5 times atmospheric pressure.

4. The internal combustion engine of claim 1 wherein a triggering pressure of said pressure-maintaining valve (10) is between 3 and 7 times atmospheric pressure.

5. The internal combustion engine of claim 4 wherein said triggering pressure is substantially 5 times atmospheric pressure.

* * * * *